United States Patent [19]

Chen

[11] Patent Number: 5,038,420

[45] Date of Patent: Aug. 13, 1991

[54] BATHING APPARATUS HAVING AUTOMATIC CONTROL MEANS

[76] Inventor: Guo-Juh Chen, P.O. Box 55-1670, Taipei, Taiwan

[21] Appl. No.: 560,545

[22] Filed: Jul. 30, 1990

[51] Int. Cl.[5] ..... A47K 3/02

[52] U.S. Cl. ..... 4/538; 4/559; 4/584

[58] Field of Search ..... 128/66, 369, 370; 4/538, 540–545, 553, 559, 567, 568, 584, 591, 598, 641

[56] References Cited

U.S. PATENT DOCUMENTS

| | | | |
|---|---|---|---|
| 3,911,505 | 10/1975 | Zaborowsky | 4/545 X |
| 4,197.838 | 4/1980 | Shill | 128/66 |
| 4,258,444 | 3/1981 | Orszullok | 4/538 |
| 4,371,995 | 2/1983 | Donhauser | 4/528 |
| 4,903,352 | 2/1990 | Murakami | 4/541 |

FOREIGN PATENT DOCUMENTS

| | | | |
|---|---|---|---|
| 59407 | 9/1982 | European Pat. Off. | 4/584 |
| 116231 | 8/1984 | European Pat. Off. | 4/541 |
| 941936 | 11/1963 | United Kingdom | 4/584 |

*Primary Examiner*—Henry J. Recla
*Assistant Examiner*—Robert M. Fetsuga

[57] ABSTRACT

A bathing apparatus includes a bath tank formed in a casing having a bottom portion formed under the bath tank and a back portion formed rearwardly of the tank, the casing being in fluid communication with the bath tank through a plurality of apertures formed in the tank, an automatic heating starter automatically actuates a heating coil formed in the casing bottom portion for warming water in the casing, a thermostat for keeping a constant warm water temperature in the casing, a solenoid inlet valve controlled by a main switch of an electrical circuit which is opened to direct water into the tank and is automatically closed by a float switch mounted on the casing back portion and actuated by rising water level in the casing, and a solenoid drain valve which is automatically opened to drain bathed water when the main switch is automatically switched off, as pulled by a hook formed on an upper end of a guide rod having a float on a lowest end portion, when someone leaves the bath tank to lower the water level to lower the float guide rod and the hook.

6 Claims, 4 Drawing Sheets

BATHING APPARATUS HAVING AUTOMATIC CONTROL MEANS

BACKGROUND OF THE INVENTION

For relaxing and washing purpose, people may visit a public bath or sauna for cleaning and comforting purpose. However, the public bath may be in an unacceptable hygienic condition or may cause infectious diseases, harmful for human health.

If someone takes a warm bath at his or her own home, the warm water may help blood circulation to be beneficial for his or her health, However, for keeping the bath water at a warm temperature, hot water should be always added into the bathtub to prevent heat loss causing inconvenience for the user.

The present inventor has found the drawbacks of a conventional bath or bathtub and invented the present bathing apparatus having automatic control functions.

SUMMARY OF THE INVENTION

The object of the present invention is to provide a bathing apparatus including a bath tank mounted in a casing and fluidically communicating with a bottom and a back jacket of the casing and having automatic control devices for automatically heating, keeping constant temperature, draining and switching off power of the control devices for taking a warm bath conveniently and comfortably.

DETAIL DESCRIPTION

Figure 1:
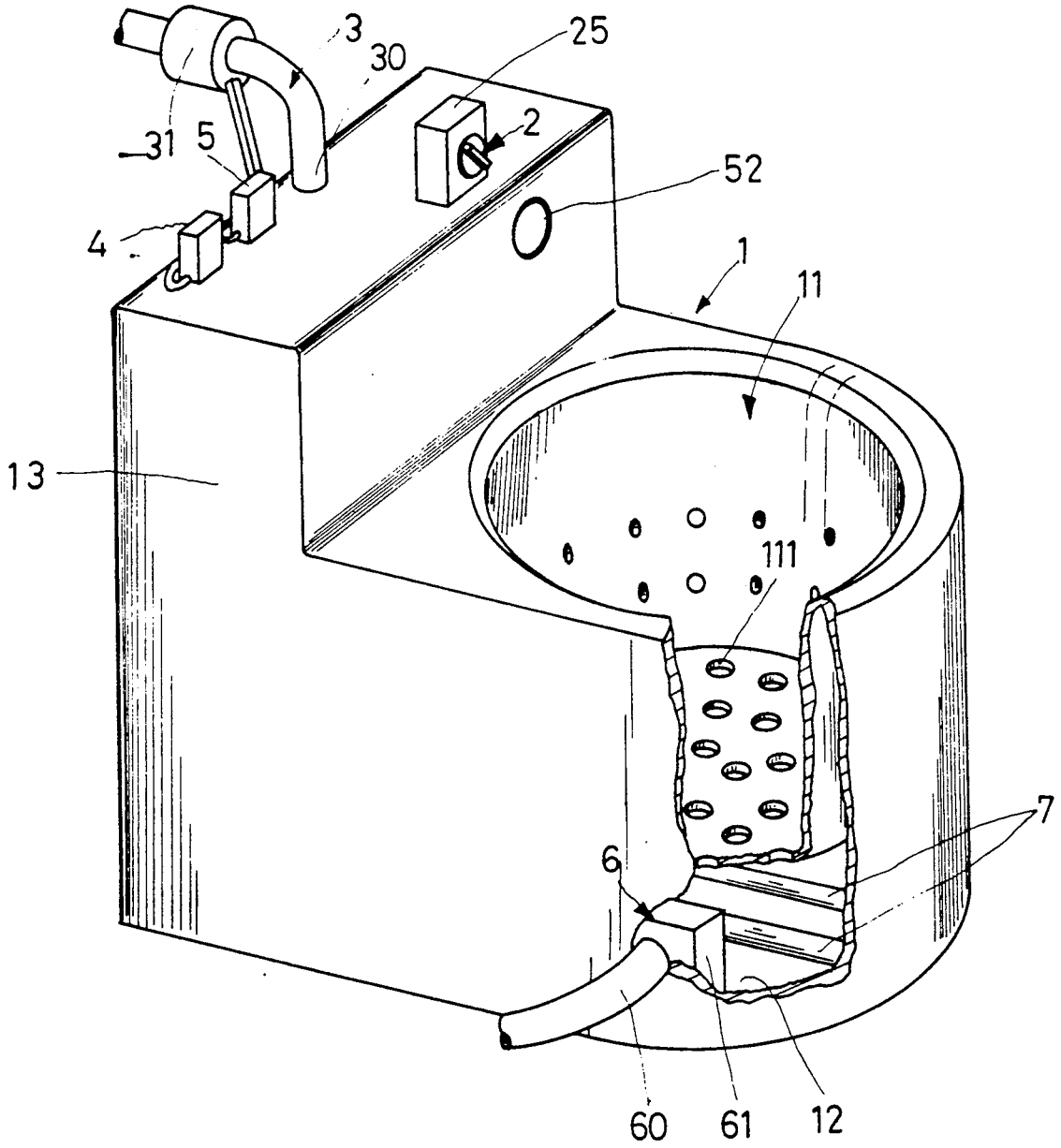
FIG. 1 is a perspective view of the present invention.
Figure 2:
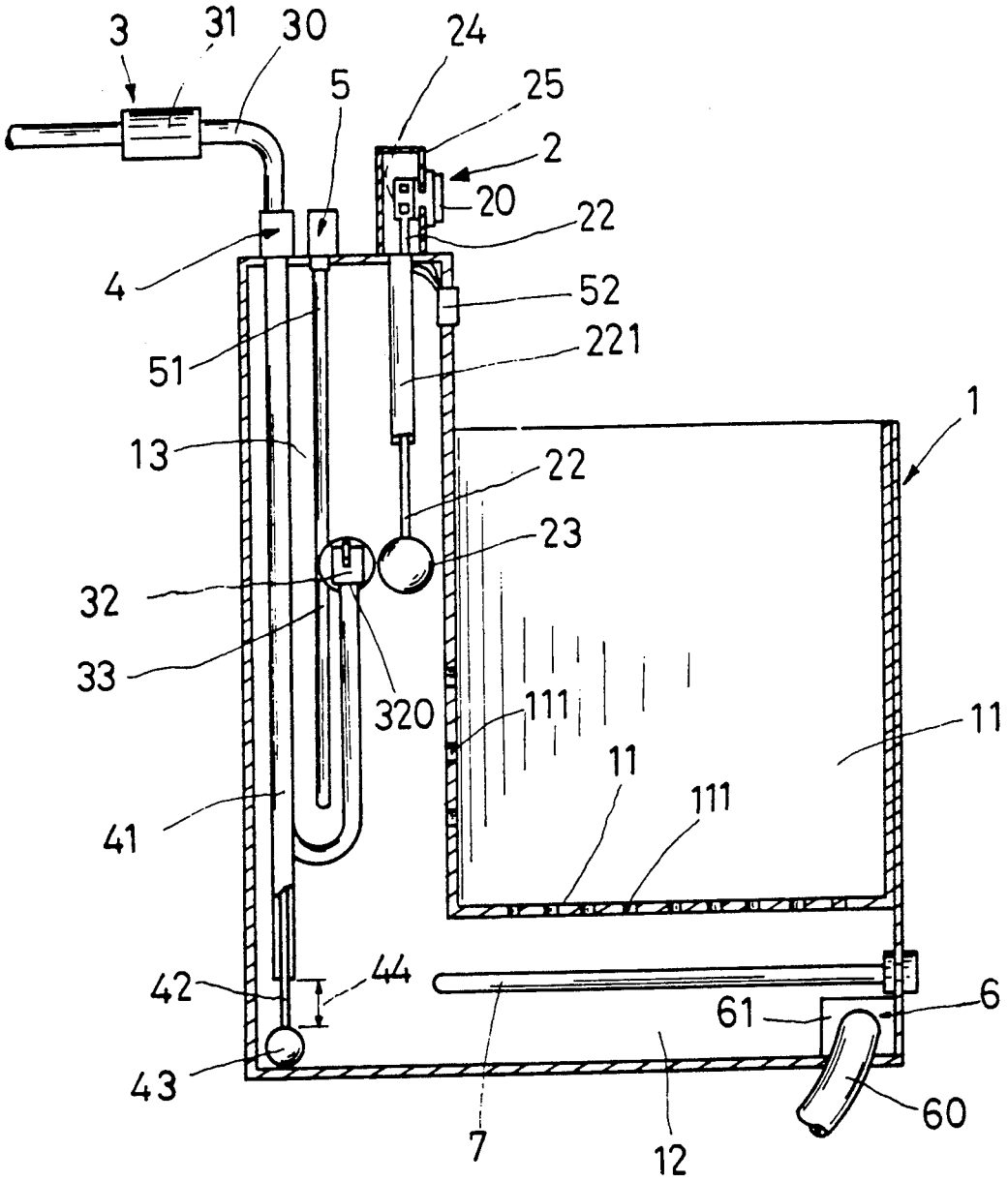
FIG. 2 is a sectional view of the present invention.

As shown in the figures, the present invention comprises: a casing 1, a main switch 2, an inlet water control means 3, an automatic heating starter 4, a thermostat 5, drain water control means 6, and a heater 7.

The casing 1 includes: a bath tank 11 generally cylindrical shaped or formed as other shapes having a plurality of perforations 111 drilled therein, a bottom jacket 12 formed in a bottom portion of the casing 1 fluidically communicates with the bath tank 11 through the perforations 111, and a back jacket 13 formed on a back portion of the casing 1 also fluidically communicates with the bath tank 11 through perforations 111 formed in the tank 11. The control means 2, 3, 4, 5 can be mounted on an upper portion of the casing 1, whereas the drain water control means 6 is mounted on the bottom portion of the casing 1. The heater 7 may be comprised of a plurality electric heating coils fixed in the bottom jacket 12 as shown in the figures.

Figure 3A:
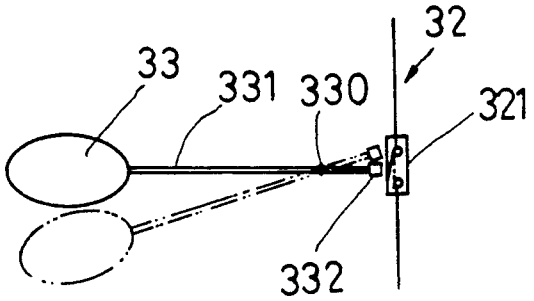
FIG. 3*a*shows the operation of a float-controlled switch of the present invention.
Figure 3:
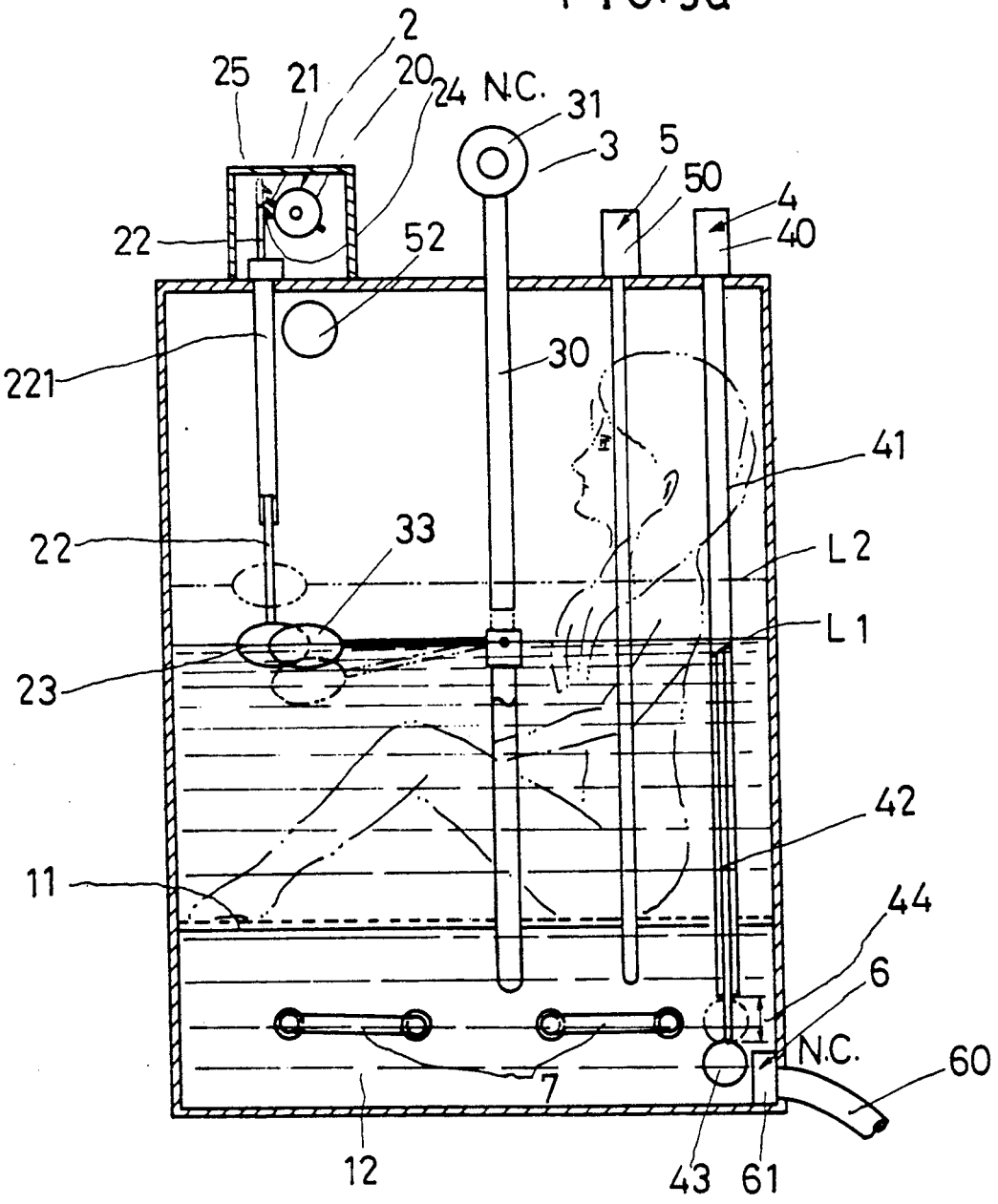
FIG. 3 is a back-view illustration showing operational water levels in the present invention.
Figure 4:
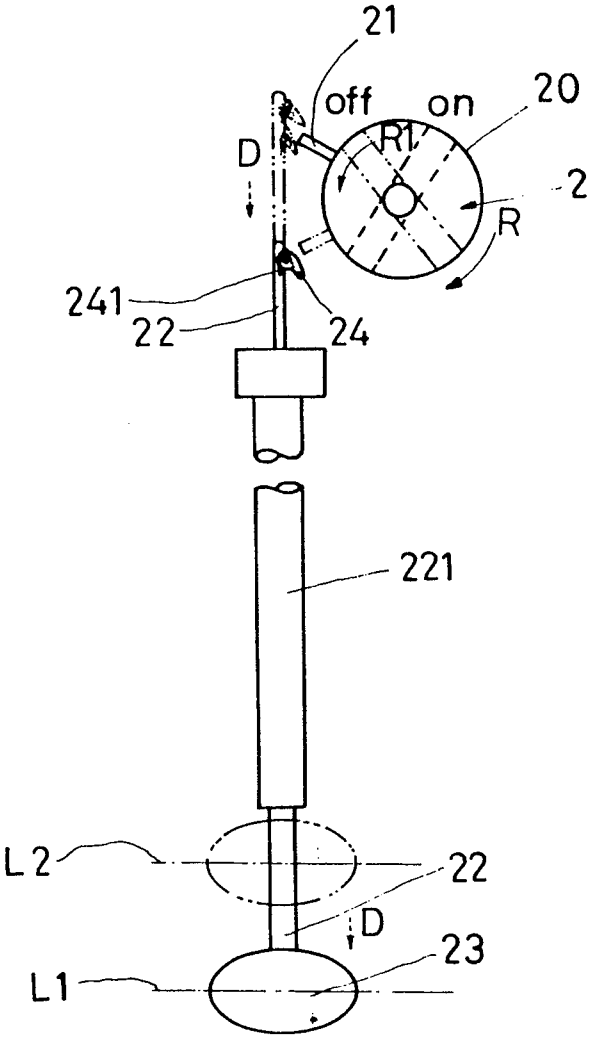
FIG. 4 shows a main electric switch of the present invention.
Figure 5:
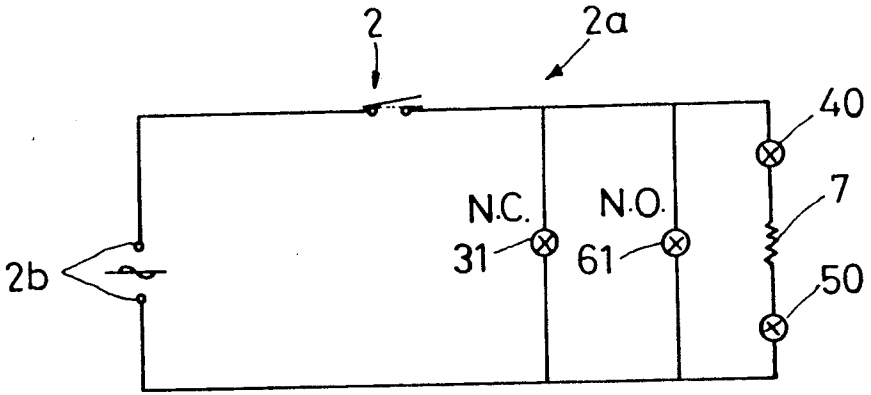
FIG. 5 shows a circuit diagram of an electrical control circuit of the present invention.

The main switch 2 stored in a switch box 25 includes: a switch knob 20 for on-off control of a power source 2*b* and an electrical control circuit 2*a* as shown in FIG. 5, a lug 21 protruding outwardly radially from the knob 20, a float 23 secured on a lowest end of a guide rod 22 reciprocating in a guide pipe 221 formed in the back jacket 13, a resilient hook 24 pivotally secured on an upper end portion of the rod 22 having a spring 241 normally urging the hook 24 outwardly to operatively pull the lug 21 downwardly (D in FIG. 4) for counterclockwise rotating the knob 20 to an "off" position (R1) and depressible to pass through then lug 21 of the knob 20 when the float 23 and rod 22 is raised by rising water level (L1 to L2 as shown in FIG. 3).

The inlet water control means 3 formed in back jacket 13 includes a solenoid inlet valve 31 normally closed (N.C.), an inlet water pipe 30, a float switch 32 such as a reed switch 321 as shown in FIG. 3*a* which can be opened as electrically attracted by a magnet 332 formed on an inner end of float arm 331 when the float 33 is raised by water level.

The automatic heating starter 4 includes a control switch 40, and a float 43 formed on a lowest end portion of a guide rod 42 reciprocating in a guide pipe 41. There is a distance 44 between the float 43 and a lowest opening of the pipe 41 allowing an upward movement of the float 43 and rod 42 for actuating the switch 40 for initiating the heating coil (heater) 7. The thermostat 5 icludes a sensing probe 51 formed in the back jacket 13 to sense the water temperature in the jackets 13, 12 and tank 11, and a control switch 50 for switching off or on of the heating coil of heater 7 for maintaining a constant temperature in the tank 11.

The drain water control means 6 includes a solenoid drain valve 61 normally opened (N.O.) and a drain pipe 60 connected with the valve 61 formed in a bottom portion of the casing 1 for draining bathed water from the tank 11 and jackets 12, 13.

In using the present invention, the knob 20 of main switch 2 is rotated clockwise (R) to the "on" position to switch on the solenoid valve 31 of inlet water control means 3 for feeding water into jackets 13, 12 and tank 11 through 11 through pipe 30 and outlet port 320, and also switch on the solenoid valve 61 of drain water control means 6 for closing the drain valve 61 of drain pipe 60. The inlet water level will rise in the jackets 12, 13 and bath tank 11 to raise the float 43 of heating starter 4 to start heating of the heater 7. After reaching a pre-determined height of water level such as L1 shown in FIG. 3, the float 33 is raised because of its buoyancy from a dotted-line shown position of FIGS. 3, 3*a* to a solid-line position to move the magnet 332 formed on an opposite end of the float 33 downwardly to attract a reed switch 321 of the float switch 32 to open the circuit of solenoid valve 31 to stop water supply from pipe 30. Other designs or modifications of float switch 32 may be done by those skilled in the art and are not limited in this invention.

After someone soaks in the bath tank 11, the water level will be raised from L1 to L2 to further raise the float 23 to raise the guide rod 22. The resilient hook 24 will pass the lug 21 of the switch knob 20 by retracting the hook (by compressing the spring 241 inwardly) to allow the raising movement of rod 22. The temperature is kept constant as controlled by the thermostat 5 for a comforting bathing when soaking in the tank 11. When the bathing is finished, someone leaves the bath tank 11 to lower the water level from L2 to L1 to lower the float 23 (which will descend by its own weight) and rod 22 from that the hook 24 will pull the lug 21 of switch knob 20 downwardly to rotate the knob 20 in direction R1 as shown in FIG. 4 to turn off the switch 2 to stop power supply to the circuit 2*a* to stop heating of heater 7. The solenoid drain valve 61 is not powered and will be normally opened to discharge the bathed water from the tank 11 and jackets 12, 13. The power is off so that the solenoid inlet valve 31 will be normally closed until the next switch-on operation of the switch 2. A circuit breaker 52 is formed in this invention to interrupt power supply of a leaking current to the wet tank 11 to prevent any injury caused by an accidental electric shock due to the leaking current.

The present invention can automatically keep a constant warm temperature for a comfortable bathing, or drain bathed water from the tank and is therefor superior to a conventional bathtub.

I claim:

1. A bathing apparatus comprising:

an open-top bath tank having a plurality of apertures formed therein;

an outer liquid-containing casing surrouding said bath tank such that a space is formed between respective side walls of said bath tank and said casing, said bath tank being supported in said casing such that a bottom wall thereof is spaced above a bottom wall of said casing and such that liquid contained in said casing can communicate with said bath tank through said apertures;

a main switch mounted on said casing and operatively connected to an electrically powered circuit for providing electrical power to the apparatus;

inlet control means connected to said circuit for controlling the flow of water from an inlet pipe to said apparatus, said inlet control means including inlet valve means for directing water into said casing, said inlet control means further including an inlet water float switch for closing said inlet valve means when a first pre-determined water level in said casing is reached;

heating means in said casing and connected to said circuit for heating the water contained therein:

an automatic heating means starter having a control switch operatively actuated by a first float responsive to a second pre-determined water level in said casing;

a thermostat operatively connected to said heating means for maintaining a constant warm water temperature in the casing; and drain control means connected to said circuit for controlling the flow of water from said casing to a drain, said outlet control means including outlet valve means for draining water from the casing, said outlet valve means being closed upon actuation of said main switch.

2. A bathing apparatus according to claim 1, wherein said main switch includes a switch knob rotatably mounted in a switch box fixed on said casing, a second float secured on a lower end of a rod reciprocating through an aperture in said casing and in a guide pipe depending from an inner surface of said casing, and a biased hook on an upper end of said rod and normally extending outwardly to operatively downwardly pull a lug protruding radially from said switch knob to switch off the electrical circuit when the water level in the casing drops from the frist pre-determined level to descend the second float.

3. A bathing apparatus according to claim 1, wherein said inlet valve means is normally closed and is operatively opened to direct inlet water into said casing when said main electric switch is switched on, said inlet water float switch including a third float on one end portion of a float arm that is pivotally secured within said casing for operatively switching off said inlet valve means when said first pre-determined water level in said casing is reached for stopping the inlet water supply.

4. A bathing apparatus according to claim 3, wherein said inlet water float switch further includes a normally closed switch that is operatively opened to switch off the inlet valve means by a magnet formed on an opposite end portion of the float arm when said third float is raised to lower said magnet.

5. A bathing apparatus according to claim 1, wherein said drain valve means normally open and operatively closed when said main electric switch is switched on.

6. A bathing apparatus according to claim 1, wherein said thermostat includes a sensing probe depending from an inner surface of said casing.

* * * * *